United States Patent [19]

Khimenko et al.

[11] 4,049,937

[45] Sept. 20, 1977

[54] INDUCTOR FOR WORKING METALS BY PRESSURE OF PULSATING MAGNETIC FIELD

[76] Inventors: Lev Timofeevich Khimenko, poselok Pokotilovka, ulitsa Ulyanovskaya, 35; Alfred Lvovich Shlyakht, ulitsa Dzerzhinskogo, 32, kv. 15, both of Kharkov, U.S.S.R.

[21] Appl. No.: 664,495

[22] Filed: Mar. 8, 1976

[51] Int. Cl.[2] ..... H05B 5/08

[52] U.S. Cl. ..... 219/7.5; 219/10.79; 336/180; 336/233

[58] Field of Search ..... 219/10.79, 149, 150, 219/152, 153, 7.5, 8.5, 6.5; 336/178, 180, 186, 192, 195, 222, 223, 233; 310/179, 180, 182, 194, 216, 254, 255

[56] References Cited

U.S. PATENT DOCUMENTS 3,124,726 3/1964 Howland ..... 219/7.5

3,399,364 8/1968 Barber ..... 336/192 X

*Primary Examiner*—Bruce A. Reynolds

*Attorney, Agent, or Firm*—Lackenbach, Lilling & Siegel

[57] ABSTRACT

Disclosure is made of an inductor for working metals by the pressure of a pulsating magnetic field, wherein on the outer surface of a concentrator, which has a working opening to receive an article to be worked and a radial slot, there are provided annular grooves, the spacings between the annular grooves forming stiffening ribs of the concentrator; laid in said annular grooves are flat helical sections of a winding, the beginning of each section enveloping an electrically conducting rod arranged in a bore extending through the concentrator, being parallel with the axis of the working opening and being next to said annular grooves; the ends of each flat helical section are interconnected in parallel by means of a bus; in said concentrator ribs, there are provided threaded holes to receive screws whose butt ends press upon the electrically conducting rod.

2 Claims, 2 Drawing Figures

INDUCTOR FOR WORKING METALS BY PRESSURE OF PULSATING MAGNETIC FIELD

The present invention relates to the working of metals by using the pressure of a pulsating magnetic field and, more particularly, to inductors for working metals by using the pressure of a pulsating magnetic field.

An important problem facing desingers of inductors for working metals by using the pressure of a pulsating magnetic field is to raise the mechanical strength and efficiency of the inductors. This is due to the great electrodynamic forces which act upon the working components of an inductor and tend to destroy it, as well as to the substantial heat losses in the current-conducting elements of the inductor.

There is known an inductor, for working metals by using the pressure of a pulsating magnetic field, comprising a concentrator with a working opening, a radial slot and annular grooves on its outer surface, each said groove receiving a flat helical winding, said annular grooves being interconnected in pairs by slots wherein there are placed current conductors which connect in pairs said windings, said slots also receiving current-conducting wedges.

There is also known an inductor, for working metals by using the pressure of a pulsating magnetic field, comprising a concentrator with a radial slot, an axial opening and a helical groove provided on its outer surface, in which groove there is laid a winding.

Disadvantages of the above-mentioned known inductors include their low mechanical strength and efficiency due to the great magnitudes of currents flowing through each winding section and to the high active resistance magnitudes of the inductor windings, which accounts for enormous electrodynamic forces acting upon the inductor turns and substantial Joule effect losses in the windings.

It is an object of the present invention to eliminate the foregoing disadvantages.

The invention essentially aims at providing an inductor, for working metals by using the pressure of a pulsating magnetic field, possessing a high mechanical strength and efficiency as a result of increasing the number of parallel turns of the inductor winding while keeping the inductor's axial dimensions at a minimum.

The foregoing objects are attained by providing an inductor for working metals by using, the pressure of a pulsating magnetic field, comprising a concentrator with a working opening to receive an article to be worked, a radial slot to connect the working opening with the outer surface of the concentrator and annular grooves on the concentrator's outer surface, each of said annular grooves receiving a flat helical winding section, the spacings between the annular grooves forming stiffening ribs of the concentrator. In the inductor's body, next to the annular grooves and parallel to the axis of the working opening, there is made, in accordance with the invention, a bore into which there is tightly inserted an electrically conducting rod enveloped by the beginning of each flat helical winding section. The ribs of the concentrator are provided with threaded holes to receive screws whose butt ends act upon the electrically conducting rod. The ends of the flat helical winding sections are interconnected in parallel by means of a collecting bus.

The foregoing design makes it possible to reduce the magnitudes of currents flowing through the turns of the winding and thus to reduce the electrodynamic forces acting upon the inductor winding; the proposed design further makes it possible to considerably decrease the active resistance magnitude of the winding and, consequently, to reduce the Joule effect losses. These factors account for high efficiency and durability of the proposed type of inductor, as well as for its long service life in terms of the number of metal working operations carried out without putting the inductor out of operation.

Other objects and advantages of the present invention will become more apparent from the following detailed description of a preferred embodiment thereof taken in conjunction with the accompanying drawings, wherein.

Figure 2:
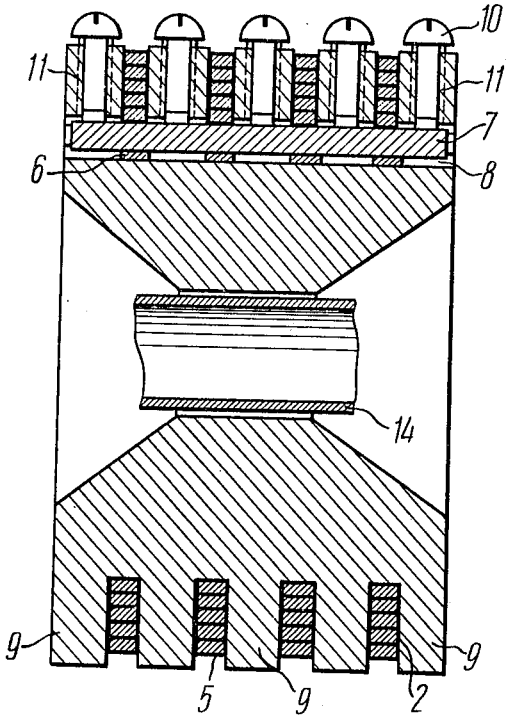
FIG. 2 is a cross sectional view taken along the line II—II of FIG. 1.
Figure 1:
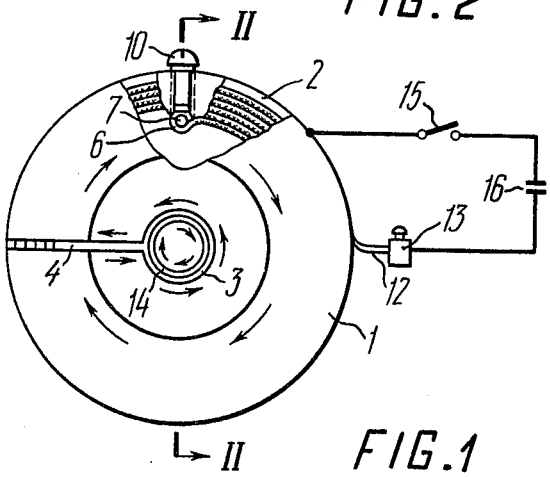
FIG. 1 is a general view, partially broken away, of an inductor for working metals by using the pressure of a pulsating magnetic field and a circuit diagram of the connection of said inductor to a power source.

Referring now to the accompanying drawings, the proposed inductor for working metals by using the pressure of a pulsating magnetic field comprises, according to the invention, a concentrator 1 (FIG. 1) in which there are made annular grooves 2 which communicates with a working opening 3 through a radial slot 4. Laid in the annular grooves 2 are flat helical sections of a winding 5. Beginnings 6 of the windings 5 are pressed against the body of the concentrator 1 by an electrically conducting rod 7 which is tightly inserted in a bore 8 (FIG. 2) provided in ribs 9 (FIG. 2) of the concentrator 1, said bore 8 being parallel to the axis of the working opening 3 of the concentrator 1 and being next to the annular grooves 2. The rod 7 is pressed upon by screws 10 received in radial threaded holes 11 (FIG. 2) provided in the ribs 9 of the concentrator 1. Ends 12 of the flat helical winding sections 5 are interconnected in parallel by means of a collecting bus 13 (FIG. 1). Installed in the working opening 3 is an article 14 to be worked. The flat helical sections of the winding 5 are electrically connected via a switching means 15 to a capacitor bank 16, whereto there is also connected the body of the concentrator 1.

The proposed inductor for working metals by using the pressure of a pulsating magnetic field operates as follows. As the switching means 15 (FIG. 1) is switched on, there flows pulse current through the electric circuit including the flat helical sections of the winding 5, which are interconnected in parallel, the elctrically conducting rod 7, the body of the concentrator 1, the collecting bus 13, and the capacitor bank 16. This current on the internal surfaces of the annular grooves 2, which are shortened by the internal surfaces of the radial slot 4 and the surface of the working opening 3, whereby an alternating magnetic flux is produced in the insulation gap between the surfaces of the working opening 3 and the article 14 being worked. Said alternating magnetic flux, in turn, induces eddy currents in the article 14 being worked, which interact with the currents flowing on the surface of the working opening 3 of the concentrator 1, whereby the article 14 is deformed. Directions of currents in the concentrator 1 and article 14 are indicated by arrows in FIG. 1. The connection of the beginning 6 of the flat helical sections of the winding 5 (FIG. 2) to the body of the concentrator 1 by means of the electrically conducting rod 7 installed in the bore 8 next to the annular grooves 2 and the connection of the end 12 of the flat helical sections of the windings 5 to the common collecting bus 13 account for a great number of parallel winding turns of the inductor. This reduces the magnitudes of currents flowing through each flat helical section of the winding 5 and, hence, the magnitudes of the electrodynamic forces acting upon the winding of the inductor. In addition, the parallel connection of the flat helical sections of the winding 5 considerably reduces the active resistance of the entire winding of the inductor, whereby heat losses are considerably reduced.

Thus, the proposed inductor for working metals by using the pressure of a pulsating magnetic field makes it possible to substantially reduce the values of electrodynamic forces acting upon the inductor, as well as the total effective resistance of the inductor winding, which raises the durability and efficiency of the inductor.

What is claimed is:

1. An inductor, for working metals by using the pressure of a pulsating magnetic field, comprising: a concentrator with a working opening to receive an article to be worked, a radial slot which connects the working opening with the outer surface of the concentrator, annular grooves provided on the outer surface of the concentrator, each annular groove receiving a flat helical section of a winding, and a bore provided in the body of said concentrator next to the annular grooves and parallel to the axis of said working opening; ribs of the concentrator disposed between said annular grooves; an electrically conducting rod tightly inserted in said bore and enveloped by the beginning of each said flat helical section of the winding; screws received in radial threaded holes provided in said ribs of the concentrator, the butt ends of said screws pressing upon said electrically conducting rod; and a collecting bus for parallel interconnection of said flat helical sections of the winding.

2. The inductor according to claim 1 further comprising: a switching means; and a capacitor, said capacitor being connected to said collecting bus and via said switching means to the outer surface of said concentrator.

* * * * *